United States Patent [19]

Winter

[11] Patent Number: 4,737,606

[45] Date of Patent: Apr. 12, 1988

[54] CIRCUIT BREAKER ARC STACK ASSEMBLY

[75] Inventor: John M. Winter, Cedar Rapids, Iowa

[73] Assignee: Square D Company, Palatine, Ill.

[21] Appl. No.: 922,966

[22] Filed: Oct. 24, 1986

[51] Int. Cl.[4] ..... H01H 33/10

[52] U.S. Cl. ..... 200/144 R; 200/146 R

[58] Field of Search ..... 200/144 R

[56] References Cited

U.S. PATENT DOCUMENTS

| | | | |
|---|---|---|---|
| 3,582,966 | 6/1971 | Strobel | 200/144 R |
| 4,393,287 | 7/1983 | Nakano | 200/144 R |
| 4,628,163 | 12/1986 | Mori et al. | 200/144 R |

*Primary Examiner*—Robert S. Macon

*Attorney, Agent, or Firm*—Richard T. Guttman; Mary R. Jankowsky; Thomas B. Lindgren

[57] ABSTRACT

A circuit breaker having an arc stack assembly that provides a longer arcing path resulting in decreased restriking characteristics during an interrupt cycle. The arc stack assembly has approximately parallel metal arc plates mounted in insulating sides. At the top of the arc stack assembly is an upper runner with a tail curving downwards to end near the uppermost arc plate. The arc horn has a prong that moves through the arc stack assembly and also through a groove in the upper runner. The tolerance between the arc and the upper runner is very close to facilitate transfer of the arc to the upper runner.

16 Claims, 5 Drawing Sheets

CIRCUIT BREAKER ARC STACK ASSEMBLY

FIELD OF THE INVENTION

The present invention relates to a circuit breaker having an arc stack assembly and more particularly to an effective, economical design for a circuit breaker having an arc stack assembly that can withstand a higher voltage drop while inhibiting restriking propensities of the internal operating mechanism.

CROSS REFERENCE TO RELATED APPLICATION

The present invention is related to material disclosed in the following copending U.S. applications, all of which are assigned to the same assignee of the present application and are herein incorporated by reference.

Ser. No. 922,577, "Trident Arc Horn for Circuit Breaker" filed Oct. 24, 1986 by A. A. Maulandi, K. J. Green, G. A. Volesky;

Ser. No. 922,968, "Circuit Breaker with Positive Contact Indication" filed Oct. 24, 1986 by J. M. Winter, D. R. Schiefen;

Ser. No. 922,576, "Circuit Breaker Contact Assembly" filed Oct. 24, 1986 by J. M. Winter;

Ser. No. 922,967, "Circuit Breaker Trip Solenoid Assembly" filed Oct. 24, 1986 by J. M. Winter, R. F. Dvorak;

Ser. No. 922,575, "Electronic Circuit Breaker with Withstand Capability" filed Oct. 24, 1986 by J. M. Winter.

BACKGROUND OF THE INVENTION

The main contacts of circuit breakers are often made of a material with a low electrical resistance, such as silver cadmium, to reduce the heat generated when the circuit breaker is closed. When the circuit breaker interrupts, an electrical arc is drawn between the separating contacts. The low resistance contact material, although beneficial for circuit breaker performance when the circuit breaker is closed, provides a poor surface for arcing since it erodes quickly under such circumstances.

In the prior art, an arc horn or arc runner was attached to the moving contact and/or stationary contact to provide a path for the arc to be blown off the respective contacts. For example, as shown in FIG. 1, a prior art circuit breaker 10 having an arc horn 16 is mounted adjacent the moving contact 12 and a lower runner 18 is positioned adjacent the stationary contact 14. Both the arc horn 16 and lower runner 18 are positioned between the contacts and the end of the circuit breaker. The arc that is drawn between the moving contact 12 and stationary contact 14 generates a high pressure which tends to force the arc out onto the arc horn 16 and lower runner 18. The end of the circuit breaker contains vents 26 which allow the arc to blow outwards from the high pressure area near the contacts to the low pressure area outside the circuit breaker 10.

Certain problems are associated with this prior art design. The vents 26 in the end of the circuit breaker 10 allow ionized gases to be blown towards the line terminal 20. This frequently results in phase to phase faults (i.e. current will flow from one conductor to another conductor) or phase to ground faults (i.e. current will flow from one conductor to ground) outside the circuit breaker in high voltage applications. The prior art design also increases the number of restrikes because the arc initially moves to the arc horn 16 and the lower runner 18 and is not blown into the arc stack 22 until later rather than early in the interruption process. As the voltage across the circuit breaker varies with the sinusoidal wave, the arc is free to move up or down the movable contact/arc horn path and the lower contact/-lower runner path. This may result in a collapse of the arc or a restrike across the contacts after a current zero and will over time cause considerable erosion of the contact material.

The collapse of the arc is a particular concern because of the quantity of ionized gases generated in the immediate area of the arc. Because ionized gas has a lower dielectric recovery voltage than does air, a restrike is more likely to occur in the immediate area previously occupied by an arc.

The prior art design also fails to utilize the full dielectric capability of the arc stack 22. The arc is drawn from the arc horn 16 to the lower runner 18 and passes close to only a portion of the arc stack plates 24, for example, the lower 60% of the arc stack plates. The arc transfers to that 60% of the arc stack plates but does not utilize the dielectric recovery voltage available from drawing an arc between the upper 40% of the arc stack plates.

SUMMARY OF THE INVENTION

The present invention is for use in a circuit breaker having an interrupting assembly which includes a moving contact, stationary contact and arc stack.

The circuit breaker shown herein is adapted to interrupt system current at 600 volts and provides a longer arcing path which results in decreased restriking characteristics during an interrupt cycle. Adjacent the movable contact is an arc horn which moves through a passage way in the arc stack as the moving contacts open. The arc is drawn between the moving arcing contact and lower arcing contact, but quickly moves to the arc horn and lower runner. The arc is then drawn between the arc horn, an upper runner, the remaining arc stack plates and the lower runner. Low clearances between the arc horn and the upper runner and between the upper runner and the highest arc stack plate ensure that the arc will transfer to each of these respective surfaces. The upper runner has a downwardly curved portion adjacent the uppermost arc stack plate. The upper runner and the lower runner are parallel to one another.

DESCRIPTION OF THE PREFERRED EMBODIMENT

Figure 2:
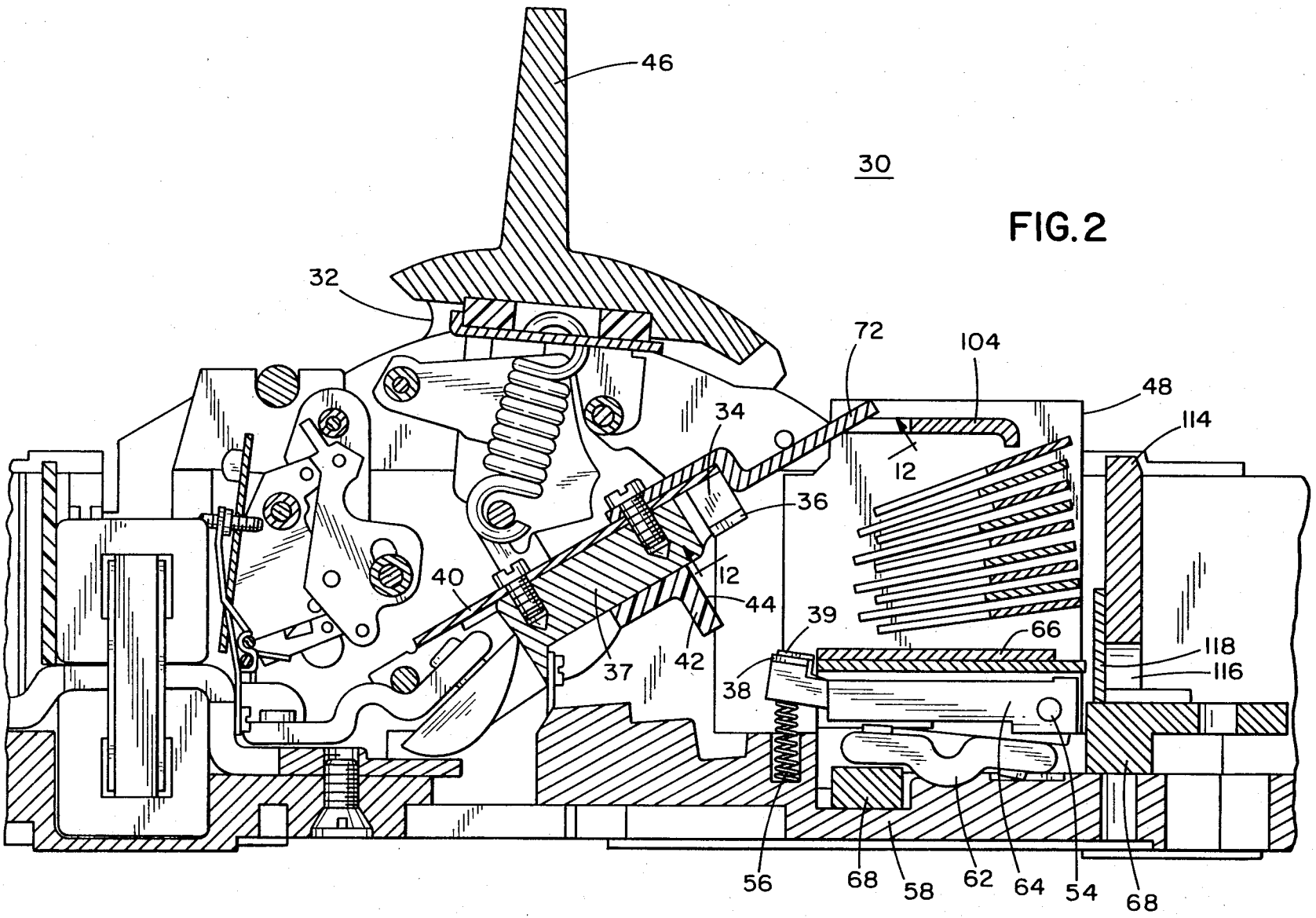
FIG. 2 is a side view of a portion of a circuit breaker that is the subject of this invention.

Referring now to the drawings, and in particular to FIG. 2, the present invention relates to a circuit breaker 30 that utilizes an operation trip mechanism, indicated generally as 32, to open the contacts upon the occurrence of an overcurrent or interrupt cycle. The details regarding the means for monitoring the current through the circuit breaker and the means for interrupting the current are not important here. It is sufficient to understand that upon the occurrence of such an overcurrent, the operating mechanism separates the moving arcing and moving main contacts 34 and 36, respectively, from the lower main and lower arcing contacts 38 and 39, respectively.

Figure 12:
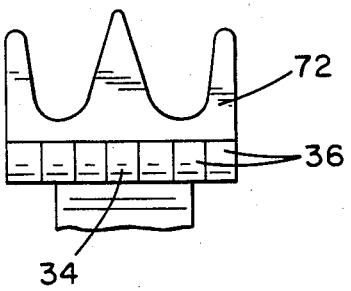
FIG. 12 is a section view of the moving contact and the arc horn taken along lines 12—12 of FIG. 2.

The moving main contacts 36 and moving arcing contact 34 are fixed to a moving blade 37 which is mounted on a moving blade carrier 40. The moving arcing contact 34, formed of silver tungsten, is positioned in the center of the moving main contacts 36 (See FIG. 12). The moving blade carrier 40 is mechanically connected to the operating trip mechanism 32 to open the contacts upon the detection of an overcurrent or upon otherwise receiving a signal to open the contacts. The circuit breaker contacts may also be opened by manually moving the operating handle 46. Attached to the underneath side of the moving blade 37 is an L-shaped back shield 42 formed of bakelite or another insulating material. The flat side 44 of the back shield 42 is positioned adjacent the moving main contacts 36 so that as the contacts begin to separate, the ionized gases formed by the arcing process are prevented from moving towards the operating trip mechanism 32. Instead, the expanding ionized gases flow outward from the contacts into the arc stack assembly 48.

Figure 8:
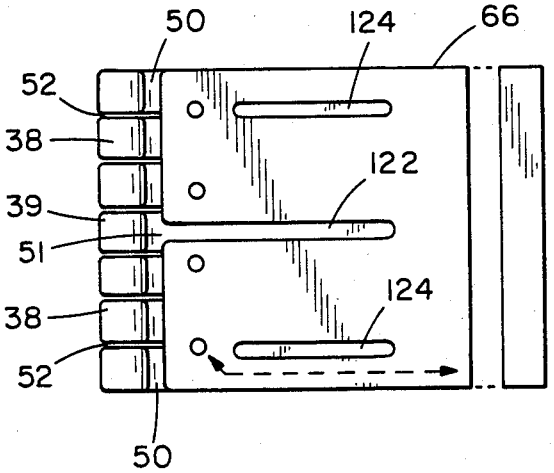
FIG. 8 is a top view of the lower contact assembly and lower runner.
Figure 11:
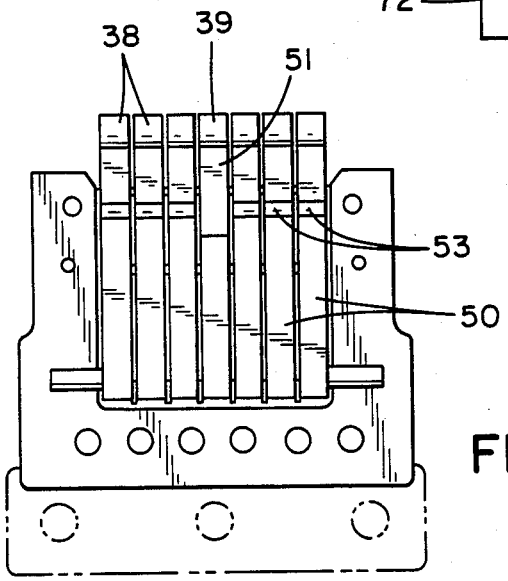
FIG. 11 is a top view of the lower blades.

Referring now to FIGS. 8 and 11 each silver tungsten lower main contact 38 (or second contact) is mounted on one of six individually silver-plated copper lower main blades 50. The silver tungsten lower arcing contact 39 is mounted on the lower arcing blade 51 that is positioned in the center of the lower main blades 50. The lower main blades 50 are nearly identical in size and composition to the lower arcing blade 51. Each of the lower main blades 50 has a stop 53 (FIG. 11) that is positioned between the respective lower main blade and the lower blade carrier 64 (See FIG. 2). The lower arcing blade 51 has no such stop. The height of the stops 53 positions the lower main blades 50 farther from the moving contacts than the lower arcing blade 51. The arc is drawn from the lower arcing contact 39.

Each pair of adjacent lower main blades 50 and lower arcing blade 51 are separated from one another by a lower spacer 52 (See FIG. 8) to ensure that each of the lower blades 50 and 51 and lower contacts (38 and 39) operate independently of one another. Referring again to FIG. 2 lower blades 50 and 51 and spacers 52 all rotate at one end about a pivot 54. A contact spring 56 is mounted between the circuit breaker housing 58 and each lower main blade 50 or lower arcing blade 51 to provide the proper contact force.

A line side flexible connector 62 mounted between the housing 58 and the lower main and arcing blades 50 and 51, respectively, also provides the electrical connection to the line terminal 68. The lower blade carrier 64 has an inverted U-shaped cross section (not shown) and is bolted to the line terminal 68 to limit the upwards movement of the lower main blades 50 and lower arcing blade 51. A lower runner 66 (or second runner) is positioned to accept the transfer of the arc from the lower main or arcing contacts.

Figure 6:
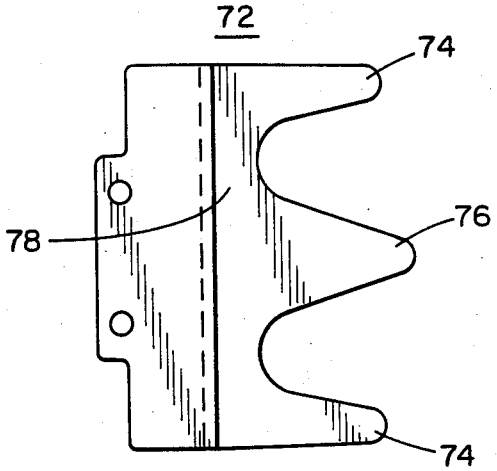
FIG. 6 is a top view of the arc horn.
Figure 9:
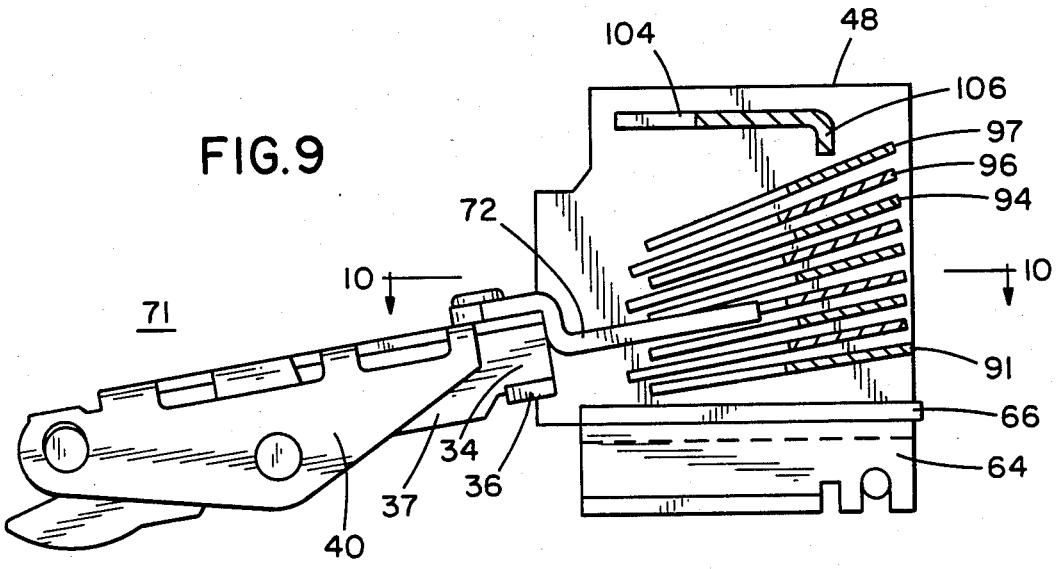
FIG. 9 is a side view of a portion of the moving contact assembly and arc stack assembly.

Referring now to FIG. 9, the moving contact assembly 71 also includes an arc horn 72. Once the arc has been drawn, the upper end of the arc moves from the moving arcing contact 34 or moving main contact 36 to the arc horn 72. The arc horn 72 may be of the trifurcate type described herein or may also be of the one prong type. The arc horn 72 shown in FIG. 6 has a middle prong 76 and two narrower outer prongs 74 connected at a base 78.

Figure 3:
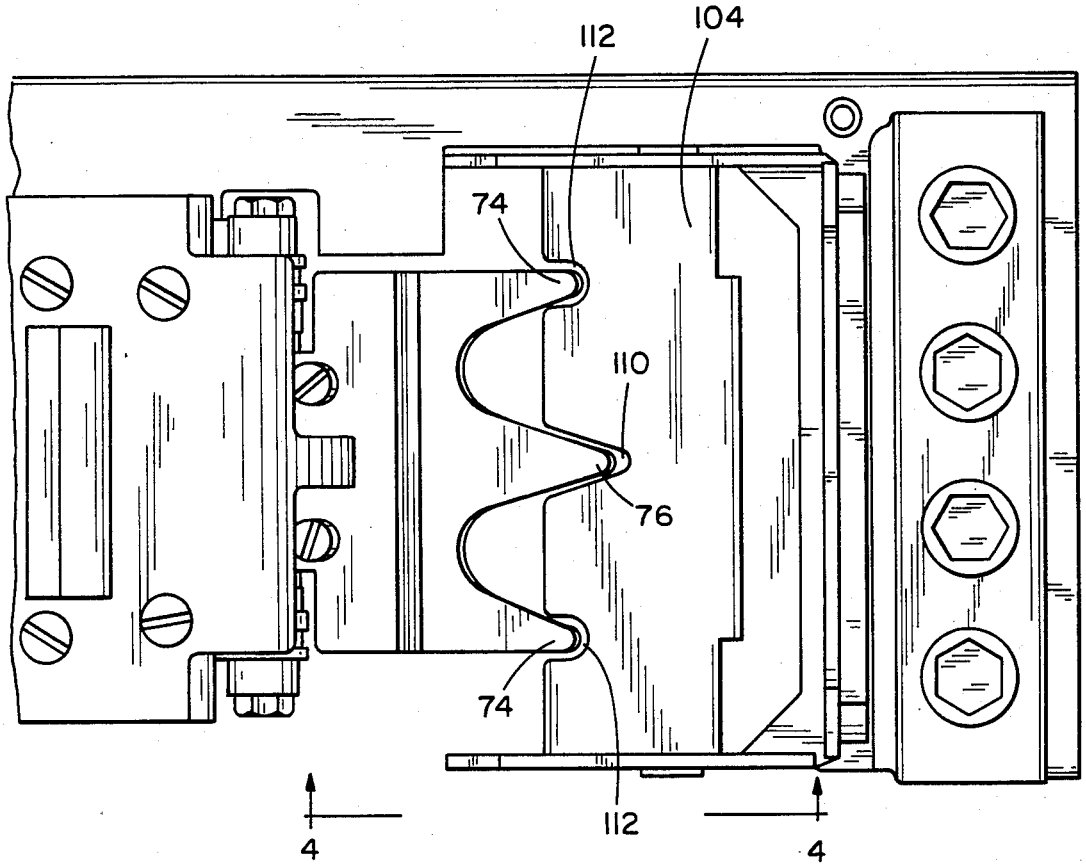
FIG. 3 is a top view of a portion of the circuit breaker of FIG. 2.
Figure 4:
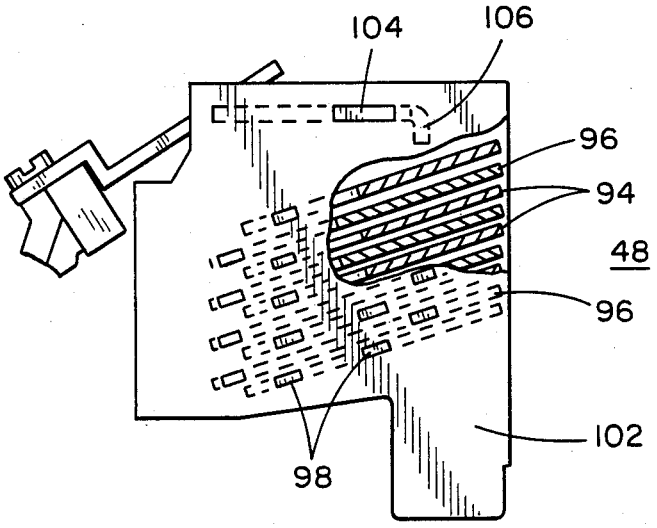
FIG. 4 is a sectional view of the arc stack assembly taken along lines 4—4 of FIG. 3.
Figure 10:
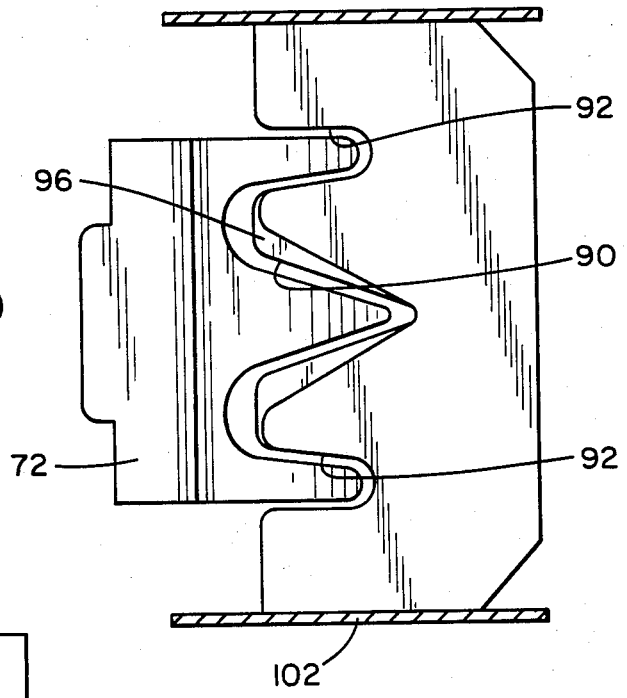
FIG. 10 is a sectional view of the arc horn and arc stack assembly taken along lines 10—10 of FIG. 9.

Each of the respective prongs 74 and 76 pass through a passageway, respectively, of the arc stack assembly 48 (See FIGS. 3 and 4). The arc stack assembly 48 is composed of nine metal arc plates, five short arc plates 94 and four long arc plates 96, spaced radially or approximately parallel from one another. Referring now to FIG. 10, each arc plate has a middle slot 90 and two outer slots 92. The short arc plates 94 are alternated with the long arc plates 96 to aid in stretching the arc and to provide higher arc voltage. Each arc plate 94 and 96 has two tabs 98 at each of its ends. These tabs 98 are positioned within the arc stack assembly sides 102 which are made of an insulating material.

Referring now to FIG. 9, the arc stack assembly 48 also includes a metal upper runner 104 (or first runner) which is positioned above the uppermost arc plate 97. The upper runner 104 is positioned parallel to the lower runner 66. The upper runner 104 has a downwardly curving tail 106 which ends adjacent the uppermost arc plate 97. Referring now to FIG. 3, the upper runner 104 has a middle groove 110 and two outer grooves 112 that are very similar to the middle slot 92 and outer slots 92 of the arc plates 94 and 96 best shown in FIG. 10. The middle groove 110 and the outer grooves 112 are sized to fit very closely with the middle prong 76 and the outer prongs 74 of the arc horn as shown in FIGS. 3 and 10.

The close tolerances between the prongs and the grooves encourage the arc to be drawn from the tip of the prong to the grooves of the upper runner 104. Referring again to FIG. 9, the arc is then drawn from the tail 106 of the upper runner 104 to the uppermost arc plate 97. The arc is also drawn between each pair of adjacent arc plates 94 and 96 and finally between the lowermost arc plate 91 and the lower runner 66. The current then flows through the lower runner 66 and the main blade carrier 64 to the line terminal 68 (See FIG. 2). When the arc is drawn through the arc stack assembly 48, as described above, the current completely bypasses the lower main blades 50, lower arcing blade 51 and the line side flexible connector 62.

Figure 1:
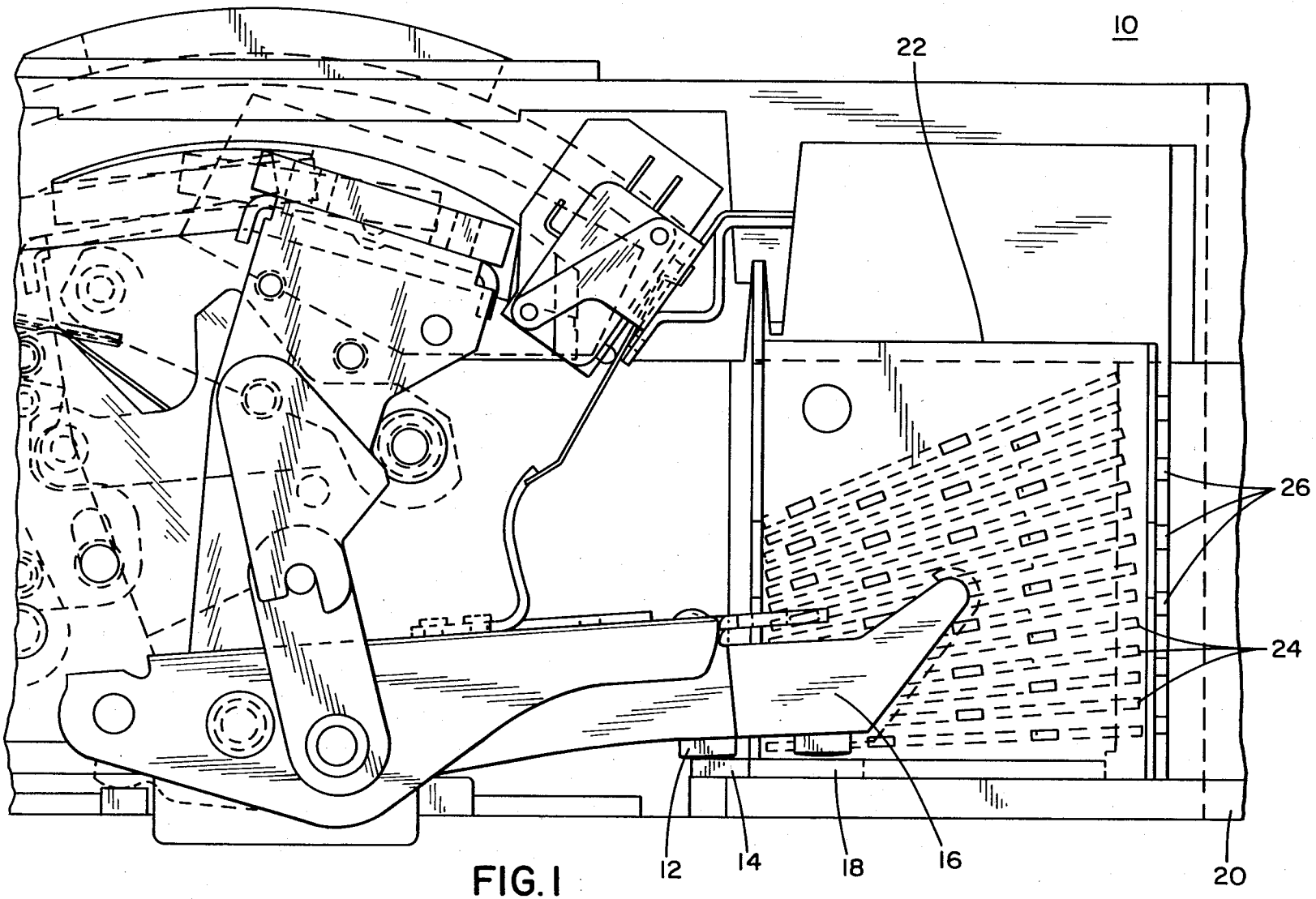
FIG. 1 PRIOR ART
FIG. 1 is a cross sectional view of a portion of a prior art circuit breaker.

In the prior art the arc is blown out from the contacts to the arc stack assembly because of the difference in pressure between the high pressure near the arcing contacts and the lower pressure area within the arc stack assembly. The back wall between the outside of the breaker and the arc stack assembly is open in the prior art. See FIG. 1, vents 26. A screen prevents objects from being inserted into the breaker. Problems occur when the ionized gas caused by an interruption was exhaled outside the breaker near the line terminals 68. Because the ionized gas has a lower dielectric voltage than air, strikeovers between phases and strikerovers from phase to ground occurred with some frequency.

Figure 5:
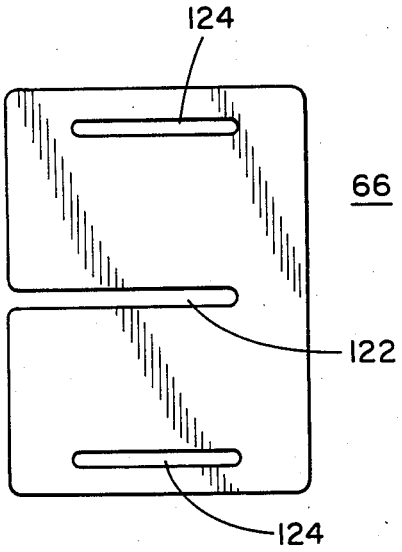
FIG. 5 is a top view of the lower runner.

The present invention eliminates this problem by sealing the end of the breaker. The back wall 114 is solid except for an small opening 116 required for the assembly of the circuit breaker. The opening 116 is later closed by an insulating sheet 118. The use of the upper runner 104 to draw out the arc and the use of slots 122 and 124 (See FIG. 5) in the lower runner 66 are sufficient to move the arc into the arc stack assembly 48 where it stabilizes.

Figure 7:
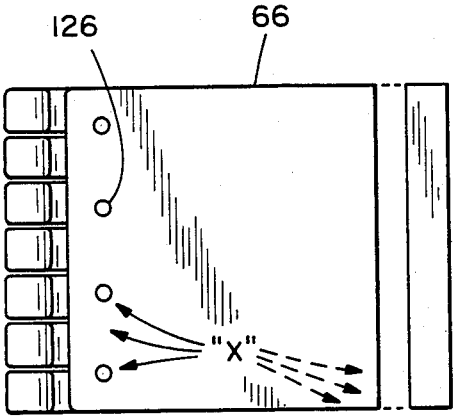
FIG. 7 PRIOR ART
FIG. 7 is a top view of a prior art lower contact assembly and lower runner.

The middle slot 122 and the outer slots 124 of the lower runner 66 help move the arc into the arc stack by directing the magnetic forces acting on the arc towards the back of the circuit breaker. In the prior art, as shown in FIG. 7, the lower runner did not include slots. In the lower runner of FIG. 7, an arc drawn from the arcing horn to the "X" on the runner 66 causes current to flow from the "X" to the lower blade carrier 64 via welds 126. The lower runner 66 is mechanically and electrically connected to the lower blade carrier (not shown) by welds 126. The magnetic forces, as indicated by the dotted lines in FIG. 7, force the arc in the direction opposite direction of the current flow. Thus the magnetic forces act in a direction towards the side of the runner as well as towards the back of the runner.

It is most desirable for the magnetics forces to act directly towards the back of runner, since this forces the arc into the arc stack assembly. By placing slots 122 and 124 in the lower runner 66 perpendicular to the back of the circuit breaker, the current flow in the lower runner 66 is parallel to the slots, as shown in FIG. 8. The magnetic flux, indicated by the dotted lines in FIG. 8, force the arc directly towards the back wall 114, moving the arc more quickly into the arc stack assembly 48.

While the invention has particularly been shown and described with reference to a preferred embodiment, it will be understood by those skilled in the art that variations in form, construction and arrangements may be made therein without departing from the spirit and scope of the invention. All such variations are intended to be covered in the appended claims.

I claim:

1. A circuit breaker comprising:

a movable contact assembly and a second contact assembly, said movable and second contact assemblies being movable between an open position and a closed position, an electric arc being operationally drawn between said movable and second contact assemblies when moving towards the open position;

a first conductive runner of a predetermined length positioned immediately adjacent said movable contact assembly when said contact assemblies are in the open position;

a second conductive runner of a predetermined length positioned adjacent to said second contact assembly, said second conductive runner being approximately parallel to said first conductive runner;

an arc stack assembly, including a plurality of approximately parallel metal arc plates, positioned between said first conductive runner and said second conductive runner, said arc stack assembly containing a first arc plate adjacent said first conductive runner and a second arc plate adjacent said second conductive runner, the arc being operationally drawn between said movable contact assembly and said first conductive runner, between said first conductive runner and the first arc plate, between the first arc plate and the second arc plate and between the second arc plate and said second conductive runner, when said contact assemblies are in the open position.

2. A circuit breaker as claimed in claim 1 wherein said first conductive runner is spaced apart from said moving contact assembly when said contact assemblies are in the closed position.

3. A circuit breaker as claimed in claim 2 wherein said first conductive runner comprises a groove through which said moving first contact assembly passes upon said moving first and second contact assemblies moving between the open position and the closed position.

4. A circuit breaker as claimed in claim 2 wherein said moving contact assembly comprises a trident arc horn positioned adjacent to the end of said moving contact assembly, the distance between said trident arc horn and said first conductive runner being not more than the distance between said first conductive runner and said second conductive runner.

5. A circuit breaker as claimed in claim 3, wherein said first conductive runner has a first end and a second end, the first end of said first conductive runner adjacent to said moving contact assembly being farther from said second conductive runner than is the second end of said first conductive runner.

6. A circuit breaker as claimed in claim 5 wherein said first conductive runner has a flat portion and a downturned trail, wherein said downturned tail is adjacent to the second end of said first conductive runner.

7. A circuit breaker as claimed in claim 6 wherein said flat portion is approximately parallel to said second conductive runner.

8. A circuit breaker comprising:

a movable contact assembly and a second contact assembly, said moveable and second contact assemblies being movable between an open position and a closed position;

a first metal runner of a predetermined length positioned adjacent said movable contact assembly in the open position, the space between said movable contact assembly in the open position and said first metal runner being approximately equal to the tolerance required between two moving parts;

a second metal runner of a predetermined length positioned justaposed said second contact assembly; and an arc stack assembly having a first arc plate and a second arc plate, said arc stack assembly being positioned between the first metal runner and the second metal runner.

9. A circuit breaker as claimed in claim 8 wherein said moveable contact assembly has an end, wherein said first metal runner comprises a groove sized and dimensioned approximately equal to the size and dimensions of the end of the moveable contact assembly.

10. A circuit breaker as claimed in claim 9 wherein said first arc plate is lower at the end adjacent said contacts than at the opposite end, wherein said first metal runner is higher at the end adjacent said contacts than at the opposite end.

11. A circuit breaker as claimed in claim 10 wherein said first metal runner comprises a flat portion and a downturned end, wherein said flat portion is adjacent said contacts and said downturned end is adjacent the opposite end.

12. A circuit breaker comprising:

a moveable contact assembly and a second contact assembly, said moveable and second contact assemblies being moveable between an open position and a closed position, an electric arc being operationally drawn between said moveable and second contact assemblies when moving towards the open position;

a first conductive runner of a predetermined length positioned immediately adjacent said moveable contact assembly when said contact assemblies are in the open position;

a second conductive runner of a predetermined length positioned adjacent to said second contact assembly, said second conductive runner being approximately parallel to said first conductive runner;

an arc stack assembly, including nine approximately parallel metal arc plates each of a predetermined size, positioned between said first metal runner and said second metal runner, said arc stack assembly containing a first arc plate adjacent said first metal runner, a second arc plate adjacent said first arc plate, a third arc plate adjacent said second arc plate, a fourth arc plate adjacent said third arc plate, a fifth arc plate adjacent said fourth arc plate, a sixth arc plate adjacent said fifth arc plate, a seventh arc plate adjacent said sixth arc plate, an eighth arc plate adjacent said seventh arc plate, and a ninth arc plate adjacent said second metal runner, the electrical arc being operationally drawn between said moveable contact assembly and said first metal runner, between said first metal runner and the first arc plate, between the first arc plate and the second arc plate, between the second arc plate and the third arc plate, between the fourth arc plate and the fifth arc plate, between the fifth arc plate and the sixth arc plate, between the sixth arc plate and the seventh arc plate, between the seventh arc plate and the eighth arc plate, between the eighth arc plate and the ninth arc plate, and between the ninth arc plate and the second metal runner, when said contact assemblies are in the open position.

13. A circuit breaker as claimed in claim 12 wherein said moveable contact assembly has an end, wherein said first metal runner comprises a groove sized and dimensioned approximately equal to the size and dimensions of the end of the moveable contact assembly.

14. A circuit breaker as claimed in claim 13 wherein said first arc plate is lower at the end adjacent said contacts than at the opposite end, wherein said first metal runner is higher at the end adjacent said contacts than at the opposite end.

15. A circuit breaker as claimed in claim 14 wherein said first metal runner comprises a flat portion and a downturned end, wherein said flat portion is adjacent said contacts and said downturned end is adjacent the opposite end.

16. A circuit breaker as claimed in claim 12 wherein said first, third, fifth, seventh and ninth metal arc plates, all of a uniform and predetermined length, are shorter in length than the second, fourth, sixth, and eighth metal arc plates, all of a uniform and predetermined length.

* * * * *